US007008262B2

(12) United States Patent
Tsai

(10) Patent No.: US 7,008,262 B2
(45) Date of Patent: Mar. 7, 2006

(54) ELECTRICAL CONNECTOR HAVING TWO VERTICALLY MOVABLE BASES TO ENHANCE OVERALL LEVELNESS OF PINS

(76) Inventor: Chou Hsuan Tsai, 15F, No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 10/746,617

(22) Filed: Dec. 23, 2003

(65) Prior Publication Data

US 2004/0137795 A1 Jul. 15, 2004

(51) Int. Cl.
*H01R 13/73* (2006.01)

(52) U.S. Cl. ..... 439/541.5; 439/64; 439/465; 439/731

(58) Field of Classification Search ..... 439/64, 439/260, 262, 264, 465, 541.5, 630, 640, 439/701, 731
See application file for complete search history.

(56) References Cited

U.S. PATENT DOCUMENTS 6,004,144 A * 12/1999 Yeh et al. ..... 439/76.1
6,146,194 A * 11/2000 Lok ..... 439/541.5
6,179,652 B1 * 1/2001 Tung et al. ..... 439/541.5
6,368,138 B1 * 4/2002 Huang ..... 439/331
6,666,724 B1 * 12/2003 Lwee ..... 439/630
6,814,622 B1 * 11/2004 Lai et al. ..... 439/631

* cited by examiner

*Primary Examiner*—Briggitte Hammond
*Assistant Examiner*—James R. Harvey
(74) *Attorney, Agent, or Firm*—Pro-Techtor Int'l Services

(57) ABSTRACT

An electrical connector includes a first base, a second base and a positioning structure. The first base has a plurality of terminals, a connection portion, two extensions formed at two sides of the connection portion, and a chamber defined by the connection portion and the extensions, and each of the plurality of terminals has a horizontal pin to be connected to a printed circuit board. The second base has a plurality of terminals, the second base is positioned in the chamber of the first base, and each of the plurality of terminals has a horizontal pin to be connected to the printed circuit board. The positioning structure is formed on the first base and the second base to make the second base vertically movable and to horizontally restrict the second base in the chamber of the first base. The connection portion is higher than the second base.

9 Claims, 6 Drawing Sheets

ELECTRICAL CONNECTOR HAVING TWO VERTICALLY MOVABLE BASES TO ENHANCE OVERALL LEVELNESS OF PINS

BACKGROUND OF THE INVENTION

1. Field of the Invention

The invention relates to an electrical connector, and more particularly to an electrical connector having two vertically movable bases to enhance overall levelness of pins.

2. Description of the Related Art

At present, the electrical connectors have been widely used in various electrical products and are developed to be more and more precise in order to facilitate the portability of the electrical products and to miniaturize the electrical products. More particularly, several electrical connectors are combined into an assembly so as to reduce the volume and to facilitate the assembling process.

However, when several electrical connectors are combined to form an assembly, the number of terminals is greatly increased. In order to make each pin of each terminal more uniformly distributed, the assembly has to be manufactured in a highly precise way, which inevitably increases the manufacturing cost. When the terminals are horizontal pins, there is an increasing need for the good overall levelness or smoothness of the pins of the terminals.

SUMMARY OF THE INVENTION

An object of the invention is to provide an electrical connector having two vertically movable bases to enhance overall levelness of pins of a plurality of terminals.

Another object of the invention is to provide an electrical connector having various electrical connector units that are combined according to redundant spaces.

Still another object of the invention is to provide an electrical connector that may be easily manufactured and have a greatly reduced manufacturing cost.

To achieve the above-mentioned objects, the invention provides an electrical connector including a first base, a second base and a positioning structure. The first base has a plurality of terminals, a connection portion, two extensions formed at two sides of the connection portion, and a chamber defined by the connection portion and the extensions, and each of the plurality of terminals has a horizontal pin to be connected to a printed circuit board. The second base has a plurality of terminals, the second base is positioned in the chamber of the first base, and each of the plurality of terminals has a horizontal pin to be connected to the printed circuit board. The positioning structure is formed on the first base and the second base to make the second base vertically movable and to horizontally restrict the second base in the chamber of the first base. The connection portion of the first base is higher than the second base.

According to the above-mentioned structure, the first and second bases are vertically movable relative to each other, and thus the plurality of terminals of the two bases may be adjusted to be located on the same plane.

DETAILED DESCRIPTION OF THE INVENTION

Figure 1:
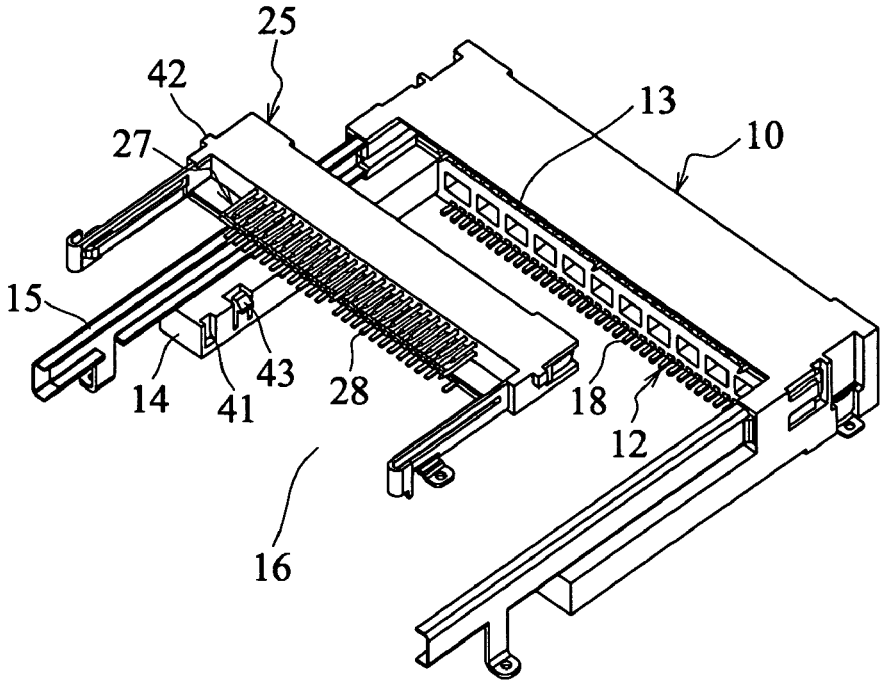
FIG. 1 is a perspective exploded view showing an electrical connector according to a first embodiment of the invention.
Figure 2:
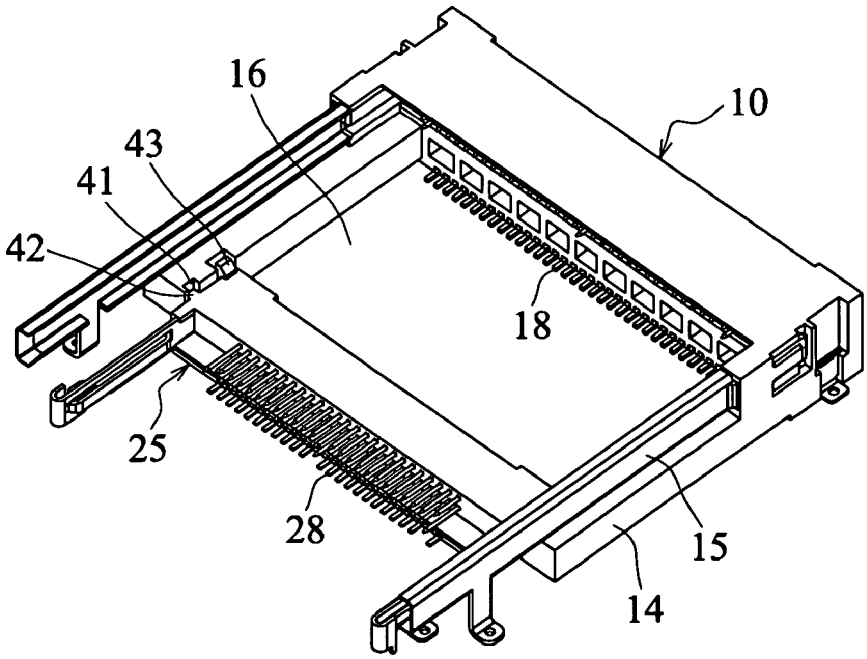
FIG. 2 is a perspective assembly illustration showing the electrical connector according to the first embodiment of the invention.
Figure 3:
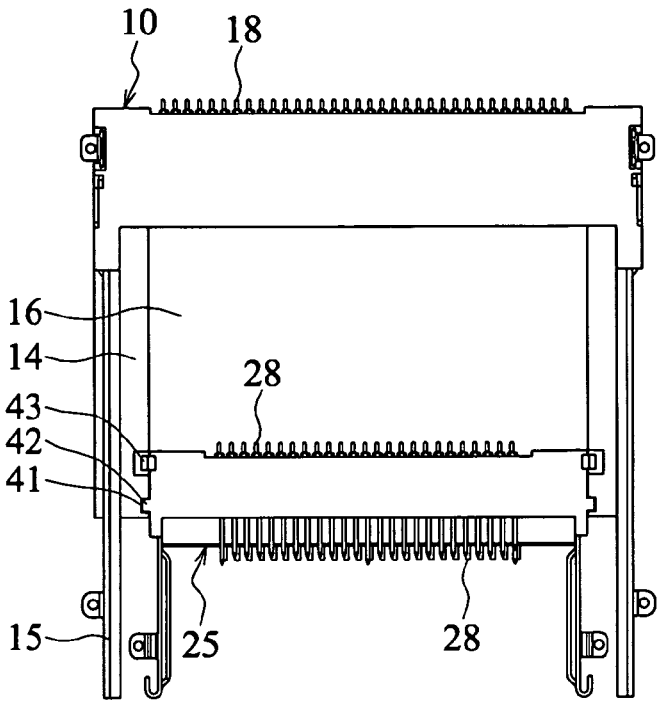
FIG. 3 is a top view showing the electrical connector according to the first embodiment of the invention.
Figure 5:
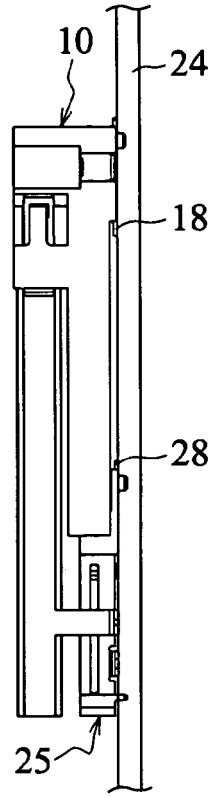
FIG. 5 is a side view showing the electrical connector according to the first embodiment of the invention.

Referring to FIGS. 1 to 5, an electrical connector according to a first embodiment of the invention includes a first base 10, a second base 25, and a positioning structure.

The first base 10 includes a plurality of terminals 12, a connection portion 13, and extensions 14 and lateral arms 15 formed at two sides of the connection portion 13. The connection portion 13 and the two extensions 14 define a chamber 16. Each terminal 12 has a horizontal pin 18 located at a bottommost position of the first base 10 and to be connected to a printed circuit board 24.

The second base 25 includes a plurality of terminals 27 and is positioned within the chamber 16 of the first base 10. Each terminal 27 has a horizontal pin 28 located at a bottommost position of the second base 25 and to be connected to the printed circuit board 24.

The positioning structure is formed on the first base 10 and the second base 25 to position and restrict the second base 25 in the chamber 16 of the first base 10. The second base 25 may only move vertically (upward and downward) but cannot move horizontally. The positioning structure includes slots 41 respectively formed at two inner sides of the two extensions 14 of the first base 10, projections 42 respectively formed at two lateral sides of the second base 25, and elastic fasteners 43 respectively formed at two inner sides of the extensions 14 of the first base 10. The projections 42 of the second base 25 are respectively engaged with the slots 41 of the first base 10 to position and restrict the second base 25 in the chamber 16 of the first base 10, wherein the second base 25 may only move vertically but cannot move horizontally. The elastic fasteners 43 may engage with or fasten the second base 25 to obtain securer positioning effects upon the combination of the first base 10 with the second base 25.

According to the above-mentioned structure, the projections 42 at two sides of the second base 25 are aligned with the slots 41 of the first base 10 before the assembling process, and then the second base 25 is placed into the chamber 16 of the first base 10. At this time, the elastic fasteners 43 at the inner sides of the extensions 14 of the first base 10 may engage with or fasten the second base 25.

Therefore, the invention has the following advantages.

1. Although the number of terminals is greater after the first and second bases 10 and 25 are combined, the overall levelness of the pins of the terminals of the two bases may be adjusted by moving the first base 10 relative to the second base 25 vertically, and thus the overall levelness may be enhanced. Consequently, the pins may be well welded to the printed circuit board.

Figure 4:
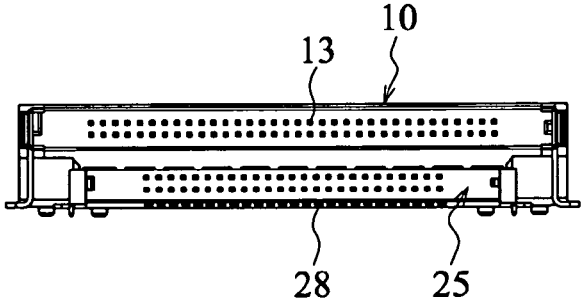
FIG. 4 is a front view showing the electrical connector according to the first embodiment of the invention.

2. Because the first base 10 is originally formed with two extensions 14 that define a large redundant chamber 16 therebetween, and the redundant chamber 16 may be utilized by positioning the second base 25 therein. The connection portion 13 of the first base 10 is higher than the second base 25, as shown in FIG. 4, so the second base 25 in front of the first base 10 will never block the first base 10.

3. Because the first base 10 may be moved vertically relative to the second base 25, good levelness of the pins of the terminals after the bases are assembled may be obtained even though the sizes of the bases are slight different. Consequently, the precision of the manufacturing processes may be lowered, and thus the products may be easily manufactured with greatly reduced manufacturing costs. In addition, after the first and second bases 10 and 25 are assembled to form an assembly, the assembly may be arranged on the printed circuit board, and thus the manufacturing costs may be reduced.

Figure 6:
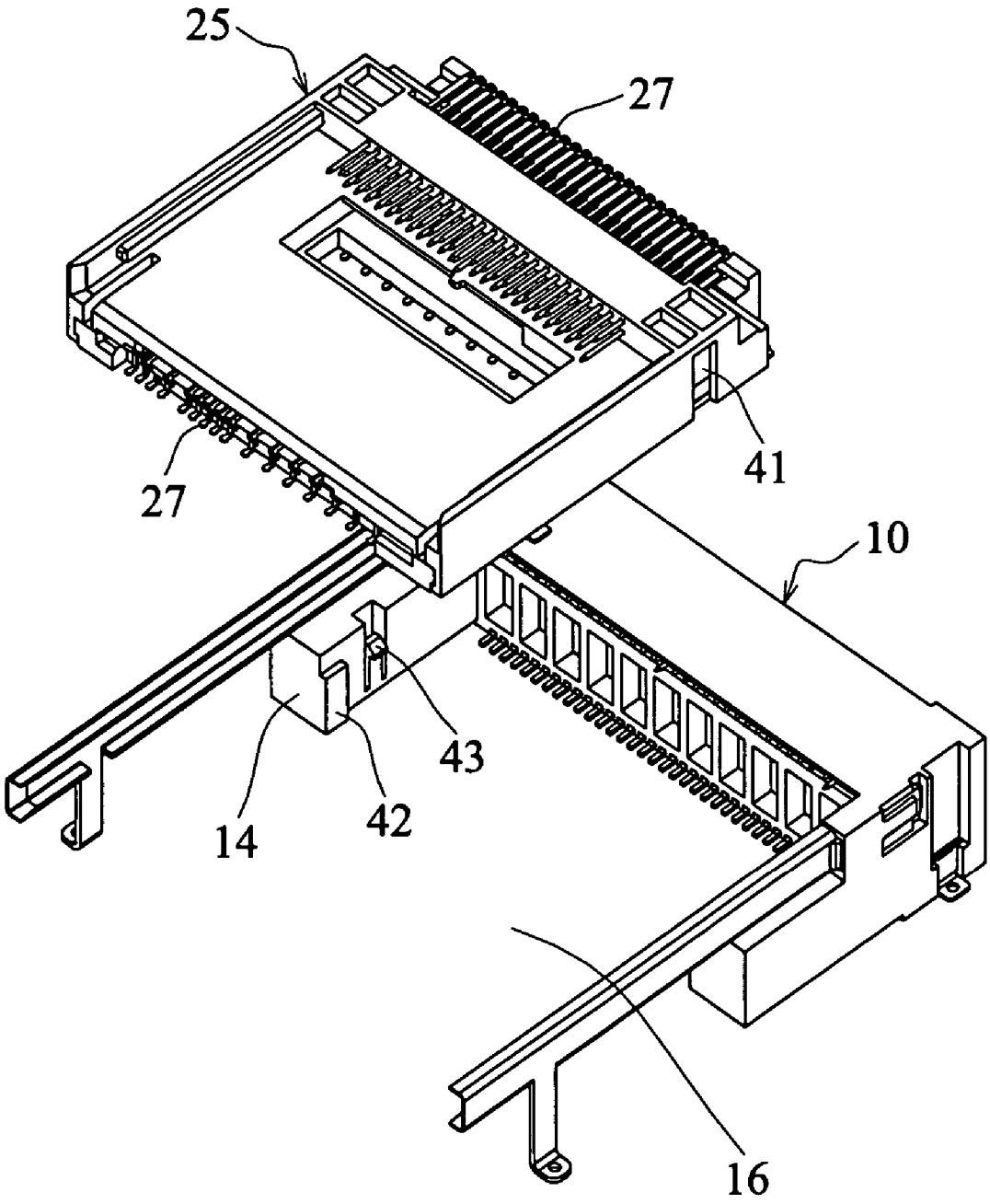
FIG. 6 is a perspective exploded view showing an electrical connector according to a second embodiment of the invention.

Referring to FIG. 6, an electrical connector of a second embodiment of the invention includes a first base 10, a second base 25, and a positioning structure, wherein the structure of the first base 10 is almost the same as that of the first embodiment while the second base 25 belongs to another kind of common base for various memory cards. The common base has a plurality of terminals 27, and the positioning structure is formed on the first base 10 and the second base 25 to restrict and position the second base 25 in the chamber 16 of the first base 10, wherein the second base 25 may only move vertically but cannot move horizontally. The positioning structure includes slots 41, projections 42, and elastic fasteners 43. The slots 41 are formed at two sides of the second base 25. The projections 42 are formed at two inner sides of the extensions 14 of the first base 10 and are engaged with the slots 41 of the second base 25 to make the second base 25 only vertically movable but not horizontally movable. The elastic fasteners 43 are formed at two inner sides of the extensions 14 of the first base 10. The elastic fasteners 43 may engage with or fasten the second base 25 to obtain securer positioning effects upon the combination of the first base 10 with the second base 25.

Figure 7:
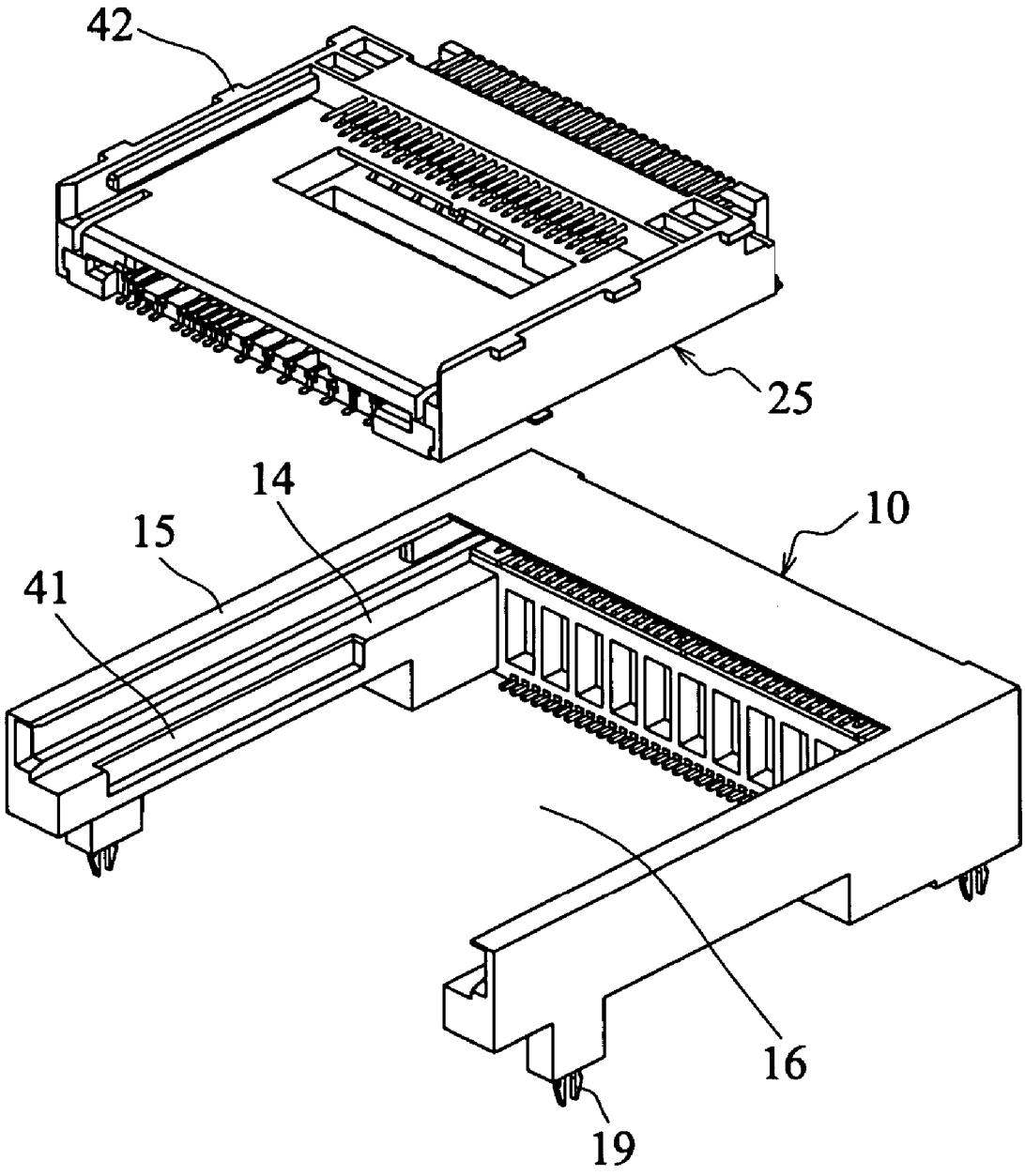
FIG. 7 is a perspective exploded view showing an electrical connector according to a third embodiment of the invention.

Referring to FIG. 7, an electrical connector of a third embodiment of the invention includes a first base 10, a second base 25, and a positioning structure, wherein the structure of the first base 10 is almost the same as that of the second embodiment, but the extensions 14 and the lateral arms 15 at two sides are one-piece molded and engagement members 19 are formed at the boundary of the first base 10. The structure of the second base 25 is almost the same as that of the second embodiment. The positioning structure is formed on the first base 10 and the second base 25 to position and restrict the second base 25 in the chamber 16 of the first base 10, wherein the second base 25 may only move vertically but cannot move horizontally. The positioning structure includes long slots 41 formed at two inner sides of the extensions 14 of the first base 10. A plurality of projections 42 is formed at two sides of the second base 25. The projections 42 of the second base 25 are engaged with the slots 41 of the first base 10 to make the first base 10 movable relative to the second base 25 in vertical directions but not in horizontal directions.

Figure 8:
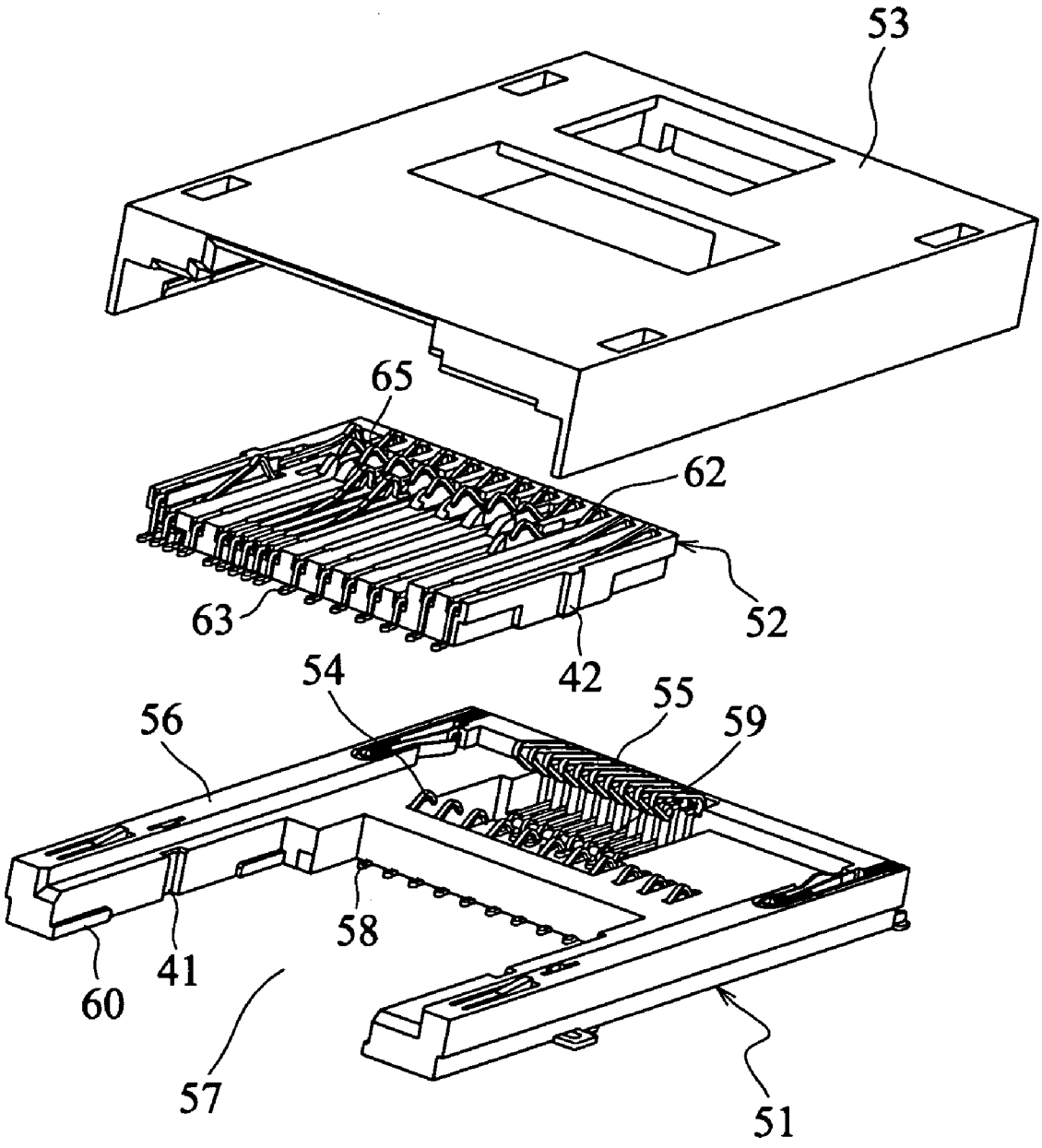
FIG. 8 is a perspective exploded view showing an electrical connector according to a fourth embodiment of the invention.

In the above-mentioned embodiments, two different types of connector units are combined to form a multi-purpose connector. However, applying the structure of the invention to the electrical connector may level the pins of the terminals at the same plane. Referring to FIG. 8, an electrical connector according to a fourth embodiment of the invention includes a first base 51, a second base 52, an upper cover 53 and a positioning structure.

The first base 51 includes a row of first terminals 54, a row of second terminals 55, extensions 56 formed at two sides of the first base 51, a chamber 57 defined between the extensions 56, and inward projections 60 formed at two inner sides of the first base 51. Each first terminal 54 has a horizontal pin 58, and each second terminal 55 has a horizontal pin 59.

The second base 52 positioned in the chamber of the first base 51 includes a row of third terminals 62 and a row of fourth terminals 65. Each third terminal 62 has a horizontal pin 63, and each fourth terminal 65 also has a horizontal pin.

The positioning structure is formed on the first base 51 and the second base 52 to make the second base 25 vertically movable but not horizontally movable in the chamber 57 of the first base 10. The positioning structure includes slots 41 and projections 42. The slots 41 are formed at two inner sides of the extensions 56 of the first base 51. The projections 42 are formed at two sides of the second base 52. The projections 42 of the second base 52 are engaged with the slots 41 of the first base 51 to restrict the second base 52 in the horizontal direction and make it only movable in the vertical direction.

The upper cover 53 is mounted to the first base 51 to cover the first base 51.

Figure 9:
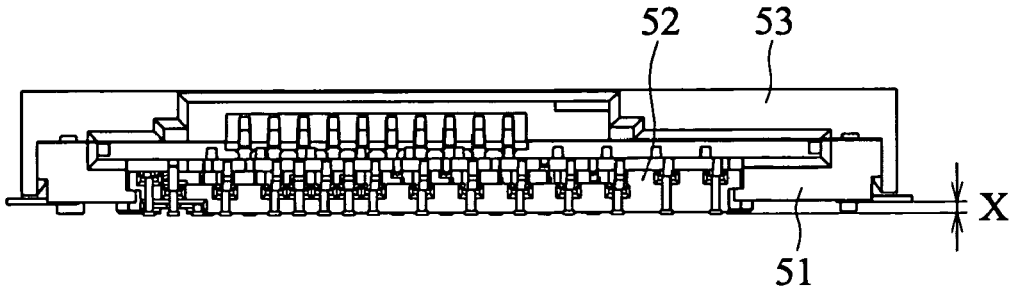
FIG. 9 is a front view showing the electrical connector according to the fourth embodiment of the invention.
Figure 10:
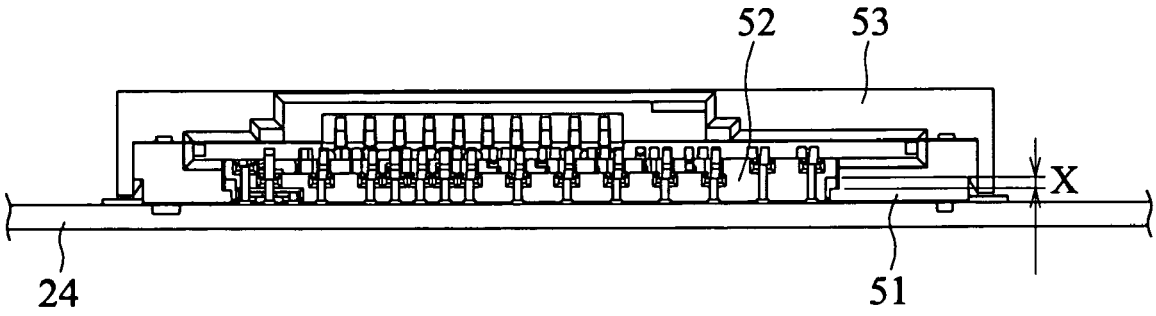
FIG. 10 shows the usage state of the electrical connector according to the fourth embodiment of the invention.

As shown in FIG. 9, during the assembling processes, the projections 42 of the second base 52 are first aligned with the slots 41 of the first base 51, and then the second base 52 is placed into the chamber 57. Next, the upper cover 53 is mounted to the first base 51 to cover it. At this case, the second base 52 is positioned between the upper cover 53 and the first base 51. Before this assembly of the first and second bases is arranged on the printed circuit board, the downward movable distance x of the second base 52 is about 0.6 mm. When this assembly is arranged on the printed circuit board 24, as shown in FIG. 10, the second base 52 is moved upwards by the distance x relative to the first base 51. Using such a floating structure may eliminate the small manufacturing errors in dimensions of the first and second bases 51 and 52 because the two bases may be moved relative to each other. Thus, the pins of the terminals may be located on the same plane, and the overall levelness of the pins may be enhanced.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. An electrical connector, comprising:

a first base having a plurality of terminals, a connection portion, two extensions formed at two sides of the connection portion, and a chamber defined by the connection portion and the extensions, each of the plurality of terminals of the first base having a horizontal pin to be connected to a printed circuit board;

a second base having a plurality of terminals, the second base being positioned in the chamber of the first base, each of the plurality of terminals of the second base having a horizontal pin to be connected to the printed circuit board; and a positioning structure formed on the first base and the second base to make the second base vertically movable and to horizontally restrict the second base in the chamber of the first base, wherein the connection portion of the first base is higher than the second base.

2. The electrical connector according to claim 1, wherein the positioning structure comprises:

a projection formed on the first base; and a slot formed on the second base, the slot of the second base being only vertically movably engaged with the projection of the first base.

3. The electrical connector according to claim 2, wherein the positioning structure further comprises an elastic fastener formed on the first base to fasten the second base.

4. The electrical connector according to claim 1, wherein the first base further has two lateral arms formed at the two sides of the connection portion.

5. The electrical connector according to claim 4, wherein the positioning structure comprises:

projections formed at two inner sides of the extensions of the first base; and slots formed at two sides of the second base, the slots of the second base being only vertically movably engaged with the projections of the first base.

6. The electrical connector according to claim 1, wherein the positioning structure comprises:

a projection formed on the second base; and a slot formed on the first base, the projection of the second base being only vertically movably engaged with the slot of the first base.

7. The electrical connector according to claim 6, wherein the positioning structure further comprises an elastic fastener formed on the first base to fasten the second base.

8. The electrical connector according to claim 4, wherein the positioning structure comprises:

slots formed at two inner sides of the extensions of the first base; and projections formed at two sides of the second base, the projections of the second base being only vertically movably engaged with the slots of the first base.

9. The electrical connector according to claim 1, wherein the horizontal pins of the first base are located at a bottommost position of the first base, and the horizontal pins of the second base are located at a bottommost position of the second base.

* * * * *